US006439219B1

(12) United States Patent
Pareti

(10) Patent No.: US 6,439,219 B1
(45) Date of Patent: Aug. 27, 2002

(54) MACHINE TOOL FOR WORKING STONE AND AGGLOMERATES OF INERT MATERIALS

(75) Inventor: Vittorio Pareti, Via Leonardo Da Vinci, 8A, 37024 Negrar (IT)

(73) Assignees: Vittorio Pareti, Negrar; Daniela Visentin, Trento, both of (IT)

( * ) Notice: Subject to any disclaimer, the term of this patent is extended or adjusted under 35 U.S.C. 154(b) by 0 days.

(21) Appl. No.: 09/496,176

(22) Filed: Feb. 2, 2000

(30) Foreign Application Priority Data

Feb. 5, 1999 (IT) ..... BZ99A0005

(51) Int. Cl.[7] ..... B28D 5/04
(52) U.S. Cl. ..... 125/36; 451/548; 451/259
(58) Field of Search ..... 125/36; 451/342, 451/343, 514, 508, 510, 548, 542, 178, 259; 248/636

(56) References Cited

U.S. PATENT DOCUMENTS 4,292,768 A * 10/1981 Panetti ..... 51/168
4,507,897 A * 4/1985 Vieau et al. ..... 51/209 R
4,693,039 A * 9/1987 Vieau et al. ..... 51/168

* cited by examiner

*Primary Examiner*—Timothy V. Eley
*Assistant Examiner*—Dung Van Nguyen
(74) *Attorney, Agent, or Firm*—Guido Modiano; Albert Josif; Daniel O'Byrne

(57) ABSTRACT

A machine tool for working stones and agglomerates of inert materials having a support for the abrasive or, respectively, cutting material to contact the stone during working and a connecting part for connecting the tool to the machine which generates and transmits to the tool the movement that the tool performs during working; the support and the connecting part are fastened to each other, in a detachable manner, by way of removable locking elements. Between the support and the connecting part a layer is interposed, made of a material which is suitable to damp the mechanical vibrations of the machine, reducing their transmission from the connecting part to the support, and suitable to damp the vibrations that occur in the support during working, and reducing further their transmission from the support to the connecting part.

9 Claims, 1 Drawing Sheet

MACHINE TOOL FOR WORKING STONE AND AGGLOMERATES OF INERT MATERIALS

BACKGROUND OF THE INVENTION

The invention relates to a tool for machines for working stone and agglomerates of inert materials, particularly for polishing, facing, cutting, milling, sizing, shaping, rabbeting, squaring or beveling natural stone, such as porphyries, granites, marbles or synthetic stone such as for example ceramics, which comprises a support for the abrasive or, respectively, cutting material that is in contact with the stone during working and a connecting part for connecting the tool to the machine that generates and transmits to the tool the movement that said tool performs during working, the support and the connecting part being mutually fastened to each other in a fixed but detachable manner by way of removable locking means.

Such machines are known as using a plurality of tools which differ in terms of shape, dimensions and technical characteristics according to the type of work the tool is designed for.

During stone working, the machines cause the tools to perform repeated movements which are typical and specific for the type of work to be performed, such as back-and-forth straight-line motions, intermittent or stepwise straight-line movements, oscillations, continuous rotations in one direction, alternating rotations in two directions, etcetera, or even a movement which is a combination of two or more movements.

Said movement is generated by the machine and transmitted to the tool. For this purpose, the tool is connected to the machine through a connecting part, which is provided with appropriate connecting means, such as for example an insertion seat for an arm or for a chuck of the machine. The tool further has a support for the abrasive or, respectively, cutting material with which the stone is worked. Said support accommodates the abrasive or, respectively, cutting material with which the stone is worked. The material is diamond-impregnated, i.e., it contains a certain amount of diamond, which being harder than the stone, allows to work said stone.

In conventional tools, the support and the connecting part are currently fastened to each other in a fixed but detachable manner by way of removable locking means, such as for example screws, grub screws and the like. This allows to disassemble the support together with the abrasive or, respectively, cutting material in order to replace it when the abrasive or the cutting material has lost its effectiveness due to wear.

Experience has shown that the abrasive or cutting material loses its effectiveness rather quickly, particularly due to the fact that the stone-like material removed during working, gums the abrasive or the cutting material gradually, reducing its removal power. However, in view of the high cost of diamond, it is a primary requirement to fully utilize the abrasive or the cutting material. In this situation, at present, when gumming of the abrasive or cutting material of the tools of a machine occurs, the position of the tools in a same machine is swapped, taking advantage from the fact that gumming does not occur uniformly, so that a tool that has become gummed by working on a certain part of the stone is generally still effective if it is used on a different part of the stone, on which another tool has been working up to that time. This method allows to extend the average life of the abrasive or of the cutting material of the tool, but the result is still unsatisfactory.

SUMMARY OF THE INVENTION

The aim of the present invention is to develop a tool of the above-mentioned type, with a reduced tendency of having gummed its abrasive or cutting material, to thus maintain its operating capabilities for a considerably longer time than currently occurs.

This aim is achieved by means of the features set forth in the characterizing part of claim 1.

In particular, between the support and the connecting part a layer is interposed, made of a material which is adapted to damp the mechanical vibrations of the machine, attenuating their transmission from the connecting part to the support, and adapted to damp the vibrations that occur in the support during work, attenuating their transmission from the support to the connecting part.

The invention is based on the finding that the mechanical vibrations of the machine and the vibrations that occur in the support of the material during machining, mutually interfere, in a way which creates occasional and irregular maximums and minimums of the vibrations, which lead to uneven action of the abrasive or cutting materials on the stone. During the maximums, the stone is not worked, but rather bitten into, by the abrasive or cutting material, so that it becomes more difficult to dress or restore the abrasive or cutting material, which consequently gums up and loses its effectiveness.

The solution according to the invention prevents, or in any case considerably reduces, the possibility of mutual contact between the two separate series of vibrations. This considerably lowers the damaging effect of the mechanical vibrations of the machine, since they no longer reach the abrasive or, respectively, cutting material.

Suitably, as set forth in claim 2, the layer is constituted by a carbon-fiber fabric. Experience has shown that such a layer has, in addition to the necessary vibration-damping characteristics described above, suitable mechanical strength characteristics which are necessary in order to contrast the forces, particularly the torsional forces, that are transmitted between the support and the connecting part.

The rigidity of the layer has a decisive effect on the characteristics of the work performed on the stone and is directly linked to the aggressive or, respectively, delicate nature of the work. The higher the rigidity of the layer, the greater the strength with which the stone is bitten into during working. By adding fibers of other materials to the carbon fibers, it is possible to vary the rigidity of the layer, adapting it to the type of stone to be worked and to the type of work to be performed.

In claims 3 to 5, preferred examples of said mixed fabrics, are claimed.

In claim 6 a particularly preferred low-cost embodiment of the present invention, is claimed in which the layer is made of glass fibers dispersed in a matrix of synthetic resin. This takes into account the fact that glass fibers have mechanical characteristics which are satisfactory, although lower than those of carbon fibers, so that such fibers may be used for producing and equipping tools meant for low-value work.

If one wishes to increase the mechanical strength of the layer, conveniently, as claimed in claim 7, the layer can be obtained by vacuum formation.

As set forth in claim 8, the empty spaces of the carbon-fiber fabric are filled with silicone and the fabric is covered with a film of silicone.

Another parameter which affects the rigidity of the layer is its thickness. Suitably, as claimed in claim 9, said layer should be less than one millimeter thick, and its thickness should be, in particular, between 3 and 8 tenths of a millimeter. Layers with a thickness of approximately or exactly 3 tenths of a millimeter make possible to work the stone more aggressively than allowed by thicknesses of approximately or exactly 8 tenths of a millimeter, which are adapted for more delicate work.

BRIEF DESCRIPTION OF THE DRAWINGS

Further characteristics and advantages of the invention will become apparent from the following description of an example of a preferred embodiment of the invention, illustrated merely by way of non-limitative example on the basis of the accompanying drawings, wherein.

DESCRIPTION OF THE PREFERRED EMBODIMENTS

Figure 1:
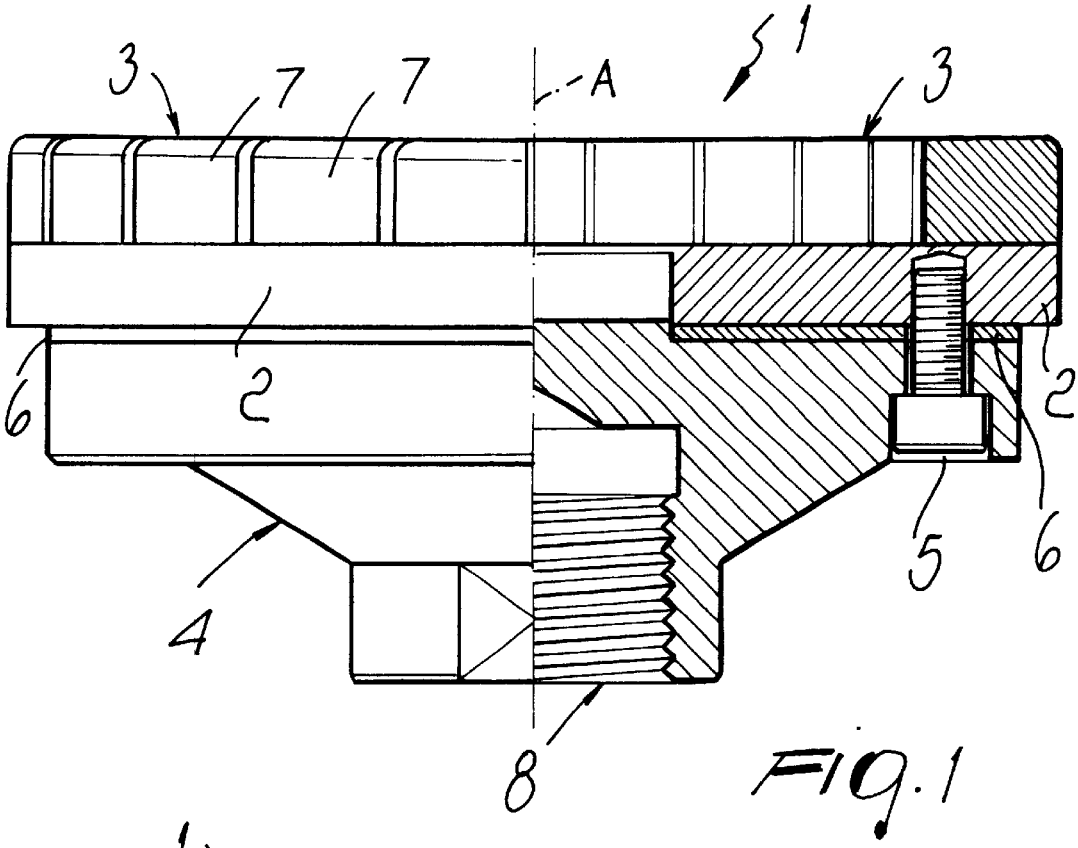
FIG. 1 is a partially sectional view of a tool according to the present invention for working a stone.

In the figures, the reference numeral 1 designates a tool for machines for working stones. The term "working" designates all possible operations to which a stone can be subjected, such as for example polishing, facing, cutting, milling, sizing, shaping, rabbeting, squaring or beveling. The stones can be natural stones, such as for example porphyries, granites, marbles or even synthetic stones such as for example ceramics.

The invention relates to all of the tools that are used in machines for working stone during said working, regardless of their shape and dimensions, so long as they comprise a support 2 for the abrasive or, respectively, cutting material 3 and a connecting part 4 for connecting the tool to the machine.

The abrasive or cutting material 3 is in contact with the stone during working, whereas the movement that the tool 1 has to perform during working is transmitted to the connecting part 4 from the machine.

Figure 2:
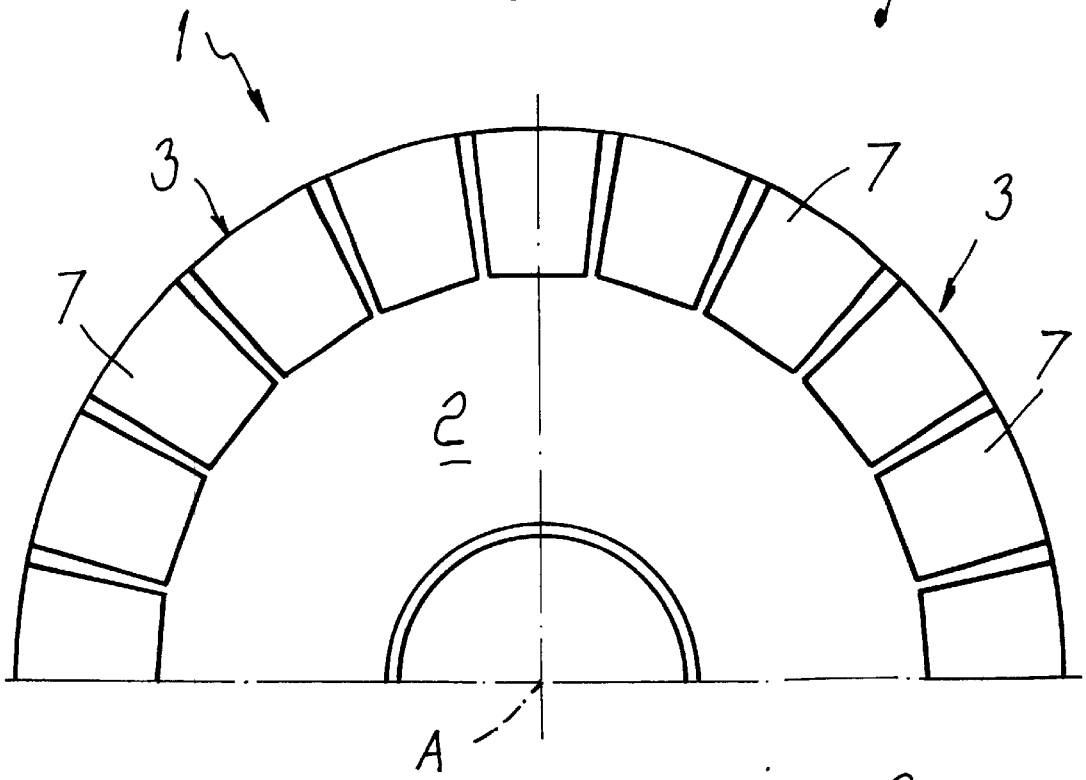
FIG. 2 is a bottom partial view of the tool of FIG. 1.

The invention will be explained on the basis of a grinding wheel 1, as shown in FIGS. 1 and 2, but it is stressed once more that this explanation is merely a representative example, and as such the invention is applicable to any tool that has characteristics as illustrated.

As shown in FIG. 1, the support 2 and the connecting part 4 are mutually fastened in a fixed but detachable manner by way of removable locking means 5, particularly screws. A plurality of diamond-impregnated sectors 7 are arranged on the support 2 to provide work surfaces for the stone, particularly for polishing and facing it, during the rotation of the tool 1 about the rotation axis A. The rotation is produced by a chuck, not shown, of a machine which also is not shown. The chuck is coupled to the tool 1 in the seat 8 of the connecting part 4. The chuck can furthermore be moved by the machine with a translatory motion, so as to move the rotating tool 1 along the stone being worked.

According to the invention, between the support 2 and the connecting part 4 a layer 6 is interposed, made of a material that is adapted to damp the mechanical vibrations of the machine and the vibrations generated in the support 2 during working. This allows to attenuate the transmission of vibrations of the machine from the connecting part 4 to the support 2, and to attenuate the transmission from the support 2 to the connecting part 4 of vibrations that originate in the abrasive or cutting material during working.

In this manner, the two different vibrational states do not interact, or only do so to a limited extent, and therefore no mutual interference occurs, which is the source of the maximums and minimums in vibrations having negative effects in terms of gumming of the abrasive or of the cutting material.

Accordingly, a more regular and controlled manner for the transmission of the power from the machine to the abrasive or cutting material is possible with the result of obtaining a doubling of the working life of the tools before gumming occurs, without compromising the quality of the work and indeed with a lower installed power capacity of the machine.

Excellent results have been achieved by using a layer 6 constituted by a carbon-fiber fabric.

It is also conceivable to provide a fabric made of mixed fibers by mixing fibers made of other materials to the carbon fibers, in order to vary the rigidity of the layer, adapting it to the requirements of the various types of work.

Examples of embodiments of said layers of mixed fabric can be obtained, by adding fibers of cardboard or natural fibers, such as for example wool, cotton, linen, silk and the like or glass fibers to the carbon fibers.

If one wishes to increase the mechanical strength of the layer 6, this can be achieved with a vacuum process, in which the carbon-fiber fabric or one of the above cited mixed-fiber fabrics is impregnated with synthetic resin and then subjected to a vacuum treatment in which it is deaerated. This gives greater compactness to the layer 6.

As an alternative, the layer 6 can be obtained by filling the empty spaces of the carbon-fiber fabric with silicone and by covering the fabric with a film of silicone.

An effective and low-cost solution, suitable in particular for situations in which it is not convenient to deal with the relatively high costs involved in carbon fiber production, is provided when the layer 6 is made of glass fibers dispersed in a resin matrix. For this solution, too, it is possible to obtain the layer 6 by using the vacuum forming process in order to improve its mechanical strength.

The layer 6 has a thickness of less than one millimeter. In particular, it has a thickness of 3 to 8 tenths of a millimeter, which is the range that provides optimum results.

The present invention therefore achieves the intended aim and objects.

The disclosures in Italian Patent Application No. BZ99A000005 from which this application claims priority are incorporated herein by reference.

What is claimed is:

1. A machine tool for working stones and agglomerates of inert materials, as by polishing, facing, cutting, milling, sizing, shaping, rabbeting, squaring or beveling natural stones, and synthetic stones, selected from a group comprising porphyries, granites, marbles and ceramics, the tool comprising: a support for any of an abrasive and a cutting material for contact with a stone during working; a connecting part for connecting the tool to an actuation machine which generates and transmits to the tool movements that said tool performs during working; removable locking means for fastening to each other said support and said connecting part in a detachable manner; and, between said support and said connecting part, an interposed layer, made of a material having damping characteristics for damping mechanical vibrations generated by the actuation machine, said layer attenuating transmission of the vibrations from the connecting part to the support and damping the vibrations generated in said support during working, and further attenuating transmission of the vibrations from said support to said connecting part, said layer being constituted by a carbon-fiber fabric.

2. The tool of claim 1, wherein said fabric comprises cardboard fibers mixed with the carbon fibers.

3. The tool of claim 1, wherein said fabric comprises natural fibers mixed with the carbon fibers.

4. The tool of claim 1, wherein said fabric comprises glass fibers mixed with the carbon fibers.

5. The tool of claim 1, comprising: empty spaces formed in said fabric filled with silicone, and a silicone film covering said fabric.

6. The tool of claim 5, wherein said layer has a thickness of less than one millimeter.

7. The tool of claim 6, wherein said layer has a thickness between 3 and 8 tenths of a millimeter.

8. A machine tool for working stones and agglomerates of inert materials, as by polishing, facing, cutting, milling, sizing, shaping, rabbeting, squaring or beveling natural stones, and synthetic stones, selected from a group comprising porphyries, granites, marbles and ceramics, the tool comprising: a support for any of an abrasive and a cutting material for contact with a stone during working; a connecting part for connecting the tool to an actuation machine which generates and transmits to the tool movements that said tool performs during working; removable locking means for fastening to each other said support and said connecting part in a detachable manner; and, between said support and said connecting part, an interposed layer, made of a material having damping characteristics for damping mechanical vibrations generated by the actuation machine, said layer attenuating transmission of the vibrations from the connecting part to the support and damping the vibrations generated in said support during working, and further attenuating transmission of the vibrations from said support to said connecting part, said layer being made of glass fibers dispersed in a synthetic resin matrix.

9. The tool of claim 8, wherein said layer is obtained through vacuum formation.

* * * * *